United States Patent [19]

Chen

[11] 4,309,226

[45] Jan. 5, 1982

[54] PROCESS FOR PREPARATION OF NEAR-ALPHA TITANIUM ALLOYS

[76] Inventor: Charlie C. Chen, 34 Adams St., Westboro, Mass. 01581

[21] Appl. No.: 134,935

[22] Filed: Apr. 28, 1980

Related U.S. Application Data

[63] Continuation of Ser. No. 949,754, Oct. 10, 1978.

[51] Int. Cl.[3] ..... C22F 1/18

[52] U.S. Cl. ..... 148/12.7 B; 148/32.5

[58] Field of Search ..... 148/12.7 B, 11.5 F, 148/32, 32.5, 158; 75/175.5

[56] References Cited

U.S. PATENT DOCUMENTS 3,833,363 9/1974 Bomberger et al. ..... 75/175.5

3,901,743 8/1975 Sprague et al. ..... 148/32.5

OTHER PUBLICATIONS

Mendritta et al., Metallurgical Transaction, vol. 5, pp. 1949–1951, Aug. 1974.

Rosenberg et al., Technical Report No. 17, Project No. 48–8 Titanium Metals Corporation of America, Henderson, Neva, Jan. 31, 1966.

Sparks, Report No. RD66–108, M.D. & E. No. 193, Wyman–Gordon Company, Worcester, MA, Feb. 1966.

Sparks, Report No. Rd67–130, M.D. & E. No. 250, Wyman–Gordon Company, Worcester, MA, 1967.

Shannon, Code 3718, Aerospace Structural Metals Handbook, vol. II, AFML–TR–68–115, Mar., 1968.

Wood et al., Titanium Alloys Handbook, Metals and Ceramics Information Center, pp. 1–6:72–1–6:72–13, Dec. 1972.

*Primary Examiner*—R. Dean

[57] ABSTRACT

Process for improving the creep strength of near-alpha titanium alloys by a specific heat treatment schedule which include solution heat treatment prior to conventional aging.

4 Claims, No Drawings

PROCESS FOR PREPARATION OF NEAR-ALPHA TITANIUM ALLOYS

This is a continuation, of application Ser. No. 949,754 filed Oct. 10, 1978.

BACKGROUND OF THE INVENTION

The present invention relates to the processing of high strength near-alpha titanium alloys, such as Ti 6242-Si (eg. Ti-6Al-2Sn-4Zr-2Mo-0.1Si), to improve the level of their mechanical properties, especially, creep strength. The Ti-6Al-2Sn-4Zr-2Mo-Si alloy was developed to fulfill the need for improved elevated-temperature performance titanium alloys, particularly for jet engine service. It is a "super-alpha" type characterized by its high strength and stability at temperatures up to about 1000° F. A "rotating" grade (RG) and a "premium" grade (PG) of 6-2-4-2 alloy as well as a "standard" grade are available in billet, bar, sheet, and plate. The density of the 6-2-4-2 alloy is 0.164 lb/in 3.

The composition and the range or maxiumums (%) are as follows:

| Major Elements | | Impurity Elements | |
|---|---|---|---|
| Aluminum | 5.5–6.5 | Iron | 0.25 |
| Tin | 1.75–2.25 | Carbon | 0.10 |
| Zirconium | 3.5–45. | Oxygen | 0.15 |
| Molybdenum | 1.75–2.25 | Hydrogen | 0.0100 (billet)<br>0.0125 (bar) |
| Silicon | 0.1–0.2 | | 0.0150 (sheet) |

The 6 percent aluminum addition in the Ti-6Al-2Sn-4Zr-2Mo composition is a potent alpha-phase stabilizer, while the 2 percent molybdenum addition represents only a moderate quantity of this potent beta-phase stabilizer. The tin and zirconium additions are solid-solution strengthening elements that are neutral with respect to phase stabilization. The net effect of this combination of alloying elements is the generation of a weakly beta-stabilized, alpha-beta alloy. Since it is weakly beta-stabilized, the alloy is also properly described as a near-alpha, alpha-beta alloy. This term is frequently referred to in abbreviated form as simply "near alpha" and the Ti-6Al-2Sn-4Zr-2Mo alloy is popularly classified with the "super" alpha compositions.

The Ti-6Al-2Sn-4Zr-2Mo alloy evolved from research conducted to improve upon the properties inherent in high-aluminum-content titanium compositions, principally high strength at elevated temperatures. However, the requirement for high strength at both room temperature and 1000° F. existed along with the need for a composition having greater thermal stability than the high-aluminum-content binary alloys. The additions of molybdenum, tin, and zirconium to the Ti-6Al base gave this new alloy the balance to satisfy these requirements. The beta-stabilizing addition, molybdenum, increases room- and elevated-temperature tensile strength and serves to enhance stability, while the combination of aluminum, tin, and zirconium maintain the long-time (creep) elevated temperature strength. The increase in density resulting from the 8 percent heavier metal additions (tin, zirconium, and molybdenum) is small, while the increase in toughness due to these additions is significant. Since the combination of alloying elements net only a weakly stabilized beta content, the alloy is weldable.

The effect of aluminum in this composition on the allotropic transformation in titanium is to stabilize the alpha phase and increase the beta transus temperature to about 1815° F. Variations in alloy composition and, in particular, variations in oxygen content, affect the beta transus temperature. Oxygen and aluminum are strong alpha-phase stabilizers. Tin, zirconium, and especially molybdenum tend to lower the beta-transus temperature.

The transformation kinetics of Ti-6Al-2Sn-4Zr-2Mo have been studied by conventional quench techniques. The study has placed the Ms temperature at about 1470° F. and the Mf temperature at about 1415° F. Transformation by nucleation and growth is very rapid.

The structures of Ti-6Al-2Sn-4Zr-2Mo alloy are typically massive equi-axed alpha in a transformed beta matrix. The equi-axed alpha grains in sheet product tend to be smaller than is found in forgings and tend to be present in greater proportion than in forgings. Primary alpha is typically about 80 to 90 percent of the structure in sheet and can range somewhat lower than this in a forged product. As in other near-alpha alloys, small amounts of residual beta phase can be observed metallographically within the transformed beta portion of the structure. The occurrence is typically between the acicular alpha grains of the transformed phase.

In addition to the standard constituents of Ti-6Al-2Sn-4Zr-2Mo, a silicon-containing modification of 6-2-4-2 is made; the nominal silicon content is 0.2 percent. Silicon additions to 6-2-4-2 probably result in the precipitation of a silicide dispersed phase and the major mechanical property benefit is to improve the elevated temperature creep strength.

Ti 6242-Si proved to have a very good mechanical characteristics in a high temperature environment compared to other alloys, but it appears to be highly desirable if the creep resistance of near-alpha titanium alloys can be improved, so that some of the heavier nickel-based super alloy components in jet engines can be replaced by titanium alloys. Although extensive work has been carried out to improve both creep strength and stability of these alloys by processing chemical modifications, current commercial near-alpha titanium alloys (e.g. Ti-6Al-2Sn-4Zr-2Mo-0.1 Si) still have limited creep resistance in the 950° F. temperature range.

At the present time, the creep resistance of this alloy has been said to relate to micro structure variations (in the magnitude of optical magnifications), but the correlation between creep and micro structure has not been adequately demonstrated. Furthermore, there exists a broad range of creep properties within a given micro structure type, which has not been satisfactorily explained.

It is, therefore, an outstanding object of the invention to provide a process schedule which improves the creep properties of near-alpha titanium alloy forgings in the 950°–1050° F. temperature range.

Another object of this invention is the provision of a process schedule which eliminates or reduces the incoherent precipitates in near-alpha titanium alloy forgings.

A further object of the present invention is the provision of a process schedule which produces improved creep properties in near-alpha titanium alloy forgings and which produces excellent combinations of tensile and fracture toughness properties.

It is another object of the instant invention to provide a near-alpha titanium alloy forging which can replace heavier nickel-based super alloy components in environments which require high creep resistance at elevated temperatures.

A still further object of the invention is the provision of a forging method for controlling the disolution state of silicon and/or tin precipitates in order to achieve higher creep resistance in Ti-6242-Si alloy.

It is a further object of the invention to provide a forging method which produces finely dispersed precipitates (solute-segregations) which act as effective barriers to immobilize dislocation movement and/or grain boundry migrations, and which thereby reduce creep deformation at high temperatures.

With the foregoing and other objects in view, which will appear as the description proceeds, the invention resides in the combination and arrangement of steps and the details of the composition hereinafter described and claimed, it being understood that changes in the precise embodiment of the invention herein disclosed may be made within the scope of what is claimed without departing from the spirit of the invention.

SUMMARY OF THE INVENTION

The main object of the present invention is to improve the creep properties of the near-$\alpha$ titanium alloys in order to extend their useful operational temperatures. The present invention establishes optimum processing schedules, comprising forge and heat-treat variables, to improve creep properties of Ti-6242 Si alloy without sacrificing strength, ductility, or fracture toughness properties.

The basic principle of the invention is to eliminate or to reduce the incoherent precipitation resulting from inadequate processing variables.

X-ray fluorescent analysis of extracted incoherent particles indicates that these precipitate particles are silicon-and tin-concentrated. It appears that a specific processing condition which directs the dissolution state of silicon (and/or tin) into a form of fine coherent precipitates and/or solid solutions is a key factor in achieving excellent creep resistance of Ti-6242 Si alloy. The finely-dispersed precipitates particles (or solute-segregation) are known to act as effective barriers which immobilize dislocation movement and grain boundary migrations, and thus minimize creep deformation at high temperatures.

In one preferred embodiment, the Ti-6242 Si is forged in the $\alpha+\beta$ temperature region, air cooled, solution heat treated at a temperature from $\beta t+100°$ F. to $\beta t+150°$ F. for 1 to 4 hours, air cooled, aged at approximately 1100° F. for 8 hours, and lastly air cooled.

In a second preferred embodiment, the Ti-6242 Si is forged above the $\beta$ transus temperature, optimally in the region from $\beta t+50°$ F. to $\beta t+150°$ F., air cooled, solution heat treated at a temperature in the region from $\beta t-59°$ F. to $\beta t-100°$ F. for 2 to 8 hours, air cooled, aged at approximately 1100° F. for approximately 8 hours, and lastly air cooled.

DESCRIPTION OF THE PREFERRED EMBODIMENT

The near-$\alpha$ titanium alloy is very attractive for jet engine components, because of its light weight and high creep strength at high temperature. Although a near-$\alpha$ titanium alloy, i.e., Ti-6Al-2Sn-4Z$\alpha$-2Mo-0.1 Si (designated as Ti-6242 Si) has been recently developed for applications in turbine discs and blades at 900°-1000° F. temperature performance, its maximum capability of creep resistance has not been realized.

The alloy used for this investigation was purchased from the producer (TMCA) as nine inch round billet (TMCA heat No. N-4694). The actual chemical compositions (percent by weight) as analyzed by Wyman-Gordon are 5.93% Al, 2.00% Sn, 4.20% Zr, 1.8% Mo, 0.11% Si, 0.08% Fe, 0.03% cu. 0.099% $O_2$, 0.011% C, 0.007% N, 0.00.32% $H_2$, and balance titanium. The $\beta$ transus temperature for this alloy heat bar was determined to be 1820° F.

Sixteen billet multiples were upset for 69% thickness reduction, both isothermally, conventionally, subtransus, and supertransus, to produce pancake forgings of approximate 1¼ inches thick by 16 inches in diameter. All pancakes were then sectioned, heat-treated, and the effects of solution treatment at temperatures from 1650° to 2000° F. and times ranging from 1 to 8 hours were investigated. Ageing treatments were made between 8 and 16 hours at 1100° F. The effects of cooling rate from forge temperature and solution-treat temperatures were also investigated. The mechanical properties measured included creep, tensile and fracture toughness. The micro-structural features associated with respective forge and heat treating histories were examined using optical, scan, and transmission electron microscopies.

It was demonstrated that the best creep properties of Ti-6242 Si alloy could not be achieved with the conventional processing schedules based on the micro-structure control at optical magnifications. The basic problem in the conventional processing arises because of the lack in understanding of the formation of incoherent precipitates. This problem has seemingly not been previously observed or reported for the Ti-6242 Si alloy. It was clearly observed in this investigation that the major factor in limiting the achievable creep of Ti-6242 Si alloy is the formation and the distribution of incoherent precipitation, which in turn, is critically dependent on the forge and heat-treat schedules.

The relationships between creep properties and optical micro structures were limited to only several extremely different conditions, e.g., transformed martensitic-$\alpha$, blobular-$\alpha$, and widmanstatten-$\alpha$. A wide range of creep properties are often observable within a given microstructure and the variations in creep can be generally related to the processing histories of the forgings.

The most common forge and heat-treat schedule for the Ti-6242 Si alloy comprises: forge at temperatures high in the $(\alpha+\beta)$ field, air-cool, solution-treat for 1 hour at temperatures high in the $(\alpha+\beta)$ field, air cool, stabilization age for 8 hours at 1100° F., and air-cool. The 0.1% creep strain at 950° F./35 ksi test condition for these $(\alpha+\beta)$ processing requires about 110 hours.

$\beta$-forgings of this alloy have been recently used in some cases to acicularize the micro structure and have shown to result in increases in creep strength and fracture toughness with a slight reduction of both strength and ductility. By using the $\alpha+\beta$ solution treatment and ageing schedules the time required to reach 0.1% creep strain of a $\beta$-forged forging is shown to increase from the $\alpha+\beta$ forged creep strain time by a factor of 2. At the present time, the times to 9.1% creep achieved by $\beta$-forged Ti-6242 Si alloy at 950° F./35 ksi test condition are in the range of 400 hours. This is equal to about 35 hours at 1050° F./25 ksi test condition.

In summary, the present invention relates the creep improvement to the forge and heat-treat processings of near-$\alpha$ titanium alloys. For $(\alpha+\beta)$ forgings, the best creep can be achieved by a $\beta$-solution treatment relatively high in the $\beta$-field ($\beta_t+100$ F.) to ($\beta_t+150$ F.), air-cooling, followed by a conventional ageing at 110 F. for about 8 hours, lastly followed by air-cooling. The solution time can be ranged from 1 to 4 hours, depending on the forge temperature.

In the case of $\beta$-forgings, the solution treatment should be conducted within the $(\alpha+\beta)$ range with optimum temperature range of $(\beta_t-50$ F.) to $(\beta_t-100$ F.), air-cooling, followed by conventional ageing at 1100° F. for about 8 hours, lastly followed by air-cooling. The solution time should be in the range of 2 to 8 hours; the time required increases as the solution temperature decreases. The optimum $\beta$-forging temperatures are in the range between $(\beta_t+50)$ and $(\beta_t+150$ F.). The above processing conditions result in minimizing or eliminating the formation of incoherent precipitates which appear to predominantly degrade the creep properties of Ti-6242 Si alloy. The achievable creep properties through the above processing conditions are 70 to 80 hours (min) 0.1% creep and 180 to 200 hours (min) 0.2% creep at 1050° F.-25 ksi test condition. Other properties associated with these processing conditions are: 130 to 135 ksi yield strength, 150 to 155 ksi UTS, 10 to 12% elongation, and 20 to 24% RD. The fracture toughness values are generally in the range of 70 ksi-$\sqrt{\text{in.}}$ of Kic.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Method for producing a near-alpha titanium alloy having high creep strength in the range from around 900° F. to 1050° F., comprising:

(a) forging at a temperature in the alpha+beta or beta temperature ranges a composition consisting essentially by weight of 6% aluminum, 2% tin, 4% zirconium, 2% molybdenum, 0.1% silicon and the remainder titanium, (b) cooling the forged composition to ambient temperature, (c) subjecting the forged composition to solution heat treatment in the temperature range from beta transus +100° F. to beta transus +150° F. for 1 to 4 hours for a composition forged in the alpha and beta temperature range and to solution heat treatment in the temperature range from beta transus −100° F. to beta transus −50° F. for 2 to 8 hours for a composition forged in the beta temperature range, (d) cooling said forged composition to ambient temperature, (e) ageing said forged composition at a temperature of about 1100° F. for at least approximately 8 hours, and (f) cooling said forged composition to ambient temperature.

2. Method of providing improved creep properties to a near-alpha titanium alloy forging of nominal composition consisting essentially by weight of 6% aluminum, 2% tin, 4% zirconium, 2% molybdenum, and 0.1% silicon with the balance titanium by restricting the formation of incoherent precipitates of silicon or tin and increasing the formation of fine, dispersed precipitates of silicon or tin, said method comprising:

(a) forging an alloy of said composition at a temperature high in alpha+beta temperature range, (b) cooling the forging to ambient temperature, (c) solution heat treating the forging at a temperature between beta transus +100° F. and beta transus +150° F. for 1 to 4 hours, (d) cooling the forging to ambient temperature, (e) ageing the forging at a temperature of about 1100° F. for at least approximately 8 hours, and (f) cooling the forging to ambient temperature.

3. Method of providing improved creep properties to a near-alpha titanium alloy forging of a nominal composition consisting essentially by weight of 6% aluminum, 2% tin, 4% zirconium, 2% molybdenum, and 0.1% silicon with the balance titanium, by restricting the formation of incoherent precipitates of silicon or tin and increasing the formation of fine, dispersed precipitates of silicon or tin, said method comprising:

(a) forging an alloy of said composition at a temperature above the beta transus temperature, (b) cooling the forging to ambient temperature, (c) solution heat-treating the forging at a temperature between beta transus −100° F. and beta transus −50° F. for 2 to 8 hours, (d) cooling the forging to ambient temperature, (e) ageing the forging at a temperature of about 1100° F. for at least approximately 8 hours, and (f) cooling the forging to ambient temperature.

4. Method as recited in claim 3, wherein the alloy is forged at a temperature in the range between beta transus +50° F. and beta transus +150° F.

* * * * *

UNITED STATES PATENT AND TRADEMARK OFFICE

CERTIFICATE OF CORRECTION

PATENT NO. : 4,309,226

DATED : January 5, 1982

INVENTOR(S) : Charlie C. Chen

It is certified that error appears in the above-identified patent and that said Letters Patent are hereby corrected as shown below:

On the title page, between lines [76] and [21], insert the following --- [73] Assignee:

Wyman-Gordon Company, Worcester, Massachusetts --.

Signed and Sealed this

*Eighth* Day of *June 1982*

[SEAL]

*Attest:*

GERALD J. MOSSINGHOFF

*Attesting Officer*

*Commissioner of Patents and Trademarks*